United States Patent [19]

Sandvik

[11] Patent Number: 4,515,329

[45] Date of Patent: May 7, 1985

[54] FEED DEVICE FOR GUIDING A ROPE ONTO A WINDING DRUM

[75] Inventor: Johannes Sandvik, Stokke, Norway

[73] Assignee: Elkem a/s, Oslo, Norway

[21] Appl. No.: 549,168

[22] Filed: Nov. 7, 1983

[30] Foreign Application Priority Data

Nov. 15, 1982 [NO] Norway ..... 823804

[51] Int. Cl.[3] ..... B65H 57/28

[52] U.S. Cl. ..... 242/157.1

[58] Field of Search ..... 242/157.1

[56] References Cited

U.S. PATENT DOCUMENTS

| | | | |
|---|---|---|---|
| 2,336,684 | 12/1943 | Hendrickson | 242/157.1 |
| 2,387,245 | 10/1945 | Davidson et al. | 242/157.1 |
| 2,453,184 | 11/1948 | Berry | 242/157.1 |
| 2,473,628 | 6/1949 | Allison | 242/157.1 |
| 2,546,794 | 3/1951 | Sole | 242/157.1 |
| 2,596,709 | 5/1952 | Moore | 242/157.1 |
| 3,248,088 | 4/1966 | Benson et al. | 242/157.1 |

FOREIGN PATENT DOCUMENTS

| | | | |
|---|---|---|---|
| 1192385 | 5/1965 | Fed. Rep. of Germany . | |
| 1025700 | 1/1953 | France | 242/157.1 |
| 261465 | 8/1949 | Switzerland | 242/157.1 |
| 587780 | 5/1947 | United Kingdom . | |
| 659246 | 10/1951 | United Kingdom . | |
| 1199916 | 7/1970 | United Kingdom . | |
| 1202090 | 8/1970 | United Kingdom . | |
| 2058703 | 4/1981 | United Kingdom . | |

*Primary Examiner*—Stanley N. Gilreath

*Attorney, Agent, or Firm*—Lucas & Just

[57] ABSTRACT

The present invention relates to a feed device for guiding rope onto winding drums on hoisting apparatus where the drum is mounted on a frame 6. The device comprises a pendulum 4 which is spherically pivoted at its upper end to the frame 6 above the drum 1 and at its lower end has secured a roller 7 intended to roll on a curved path 8 on a flange 9 mounted on the frame 6. The pendulum has at least one guide pulley 11 for the rope 2.

4 Claims, 2 Drawing Figures

FEED DEVICE FOR GUIDING A ROPE ONTO A WINDING DRUM

The present invention relates to a feed device for guiding rope onto winding drums on hoisting apparatuses where the drum is mounted on a frame.

Typical hoisting apparatuses comprise winches, cranes, excavators or the like. Particularly, but not exclusively, the present invention is specially suited for winches mounted on tractors.

The hitherto known and used feeding devices for guiding rope onto winding drums on winches comprise mechanical devices that via transimission means are operated syncronically with the rotation speed of the drum. For smaller winches, intended to be used on tractors or the like, this known feeding devices for guiding rope onto a drum, is too complicated and space-consuming, and can therefore not be used. Such small winches are therefore usually not equipped with any special device for guiding the rope onto the winding drum. Unfortunately, when the width of the winding drum exceed a minimum length, it is impossible to wind the rope closely and evenly in layers over the whole length of the drum whithout a feeding device for guiding the rope. Depending on how the fixed frame pulley is placed in the proportion to the drum, the winding of the rope on the drum is concentrated just to a part of the width of the drum as the rope will climb uncontrolled upon previous rope layers on the drum. Hence coils on subsequent rope layers will trap themselves in the spaces between coils on previous layers. The trapping of coils between coils on previous layers cause increased wear and thereby a shorter life for the rope. In addition only a part of the capacity of the drum is used.

These shortcomings have been overcome by the device according to the present invention. According to the present invention guiding of rope onto a winding drum is achieved by utilising the fact that the force necessary for the rope to climb onto previous coils on the drum is greater than the force necessary to move a pendulum which is equipped with at least one guide pulley for the rope.

According to the present invention there is provided a feed device for guiding a rope from a fixed frame pulley onto a winding drum said device comprising a pendulum that at its upper end is spherically pivoted to a frame at a point above the drum, the pendulum having a roller at its lower end intended to roll on a curved path on a flange mounted on said frame. The flange has at least the same length as the width of the drum end is arranged parallel to the axis of rotation of the drum. At least one guide pulley for the rope is mounted on the pendulum.

Figure 1:
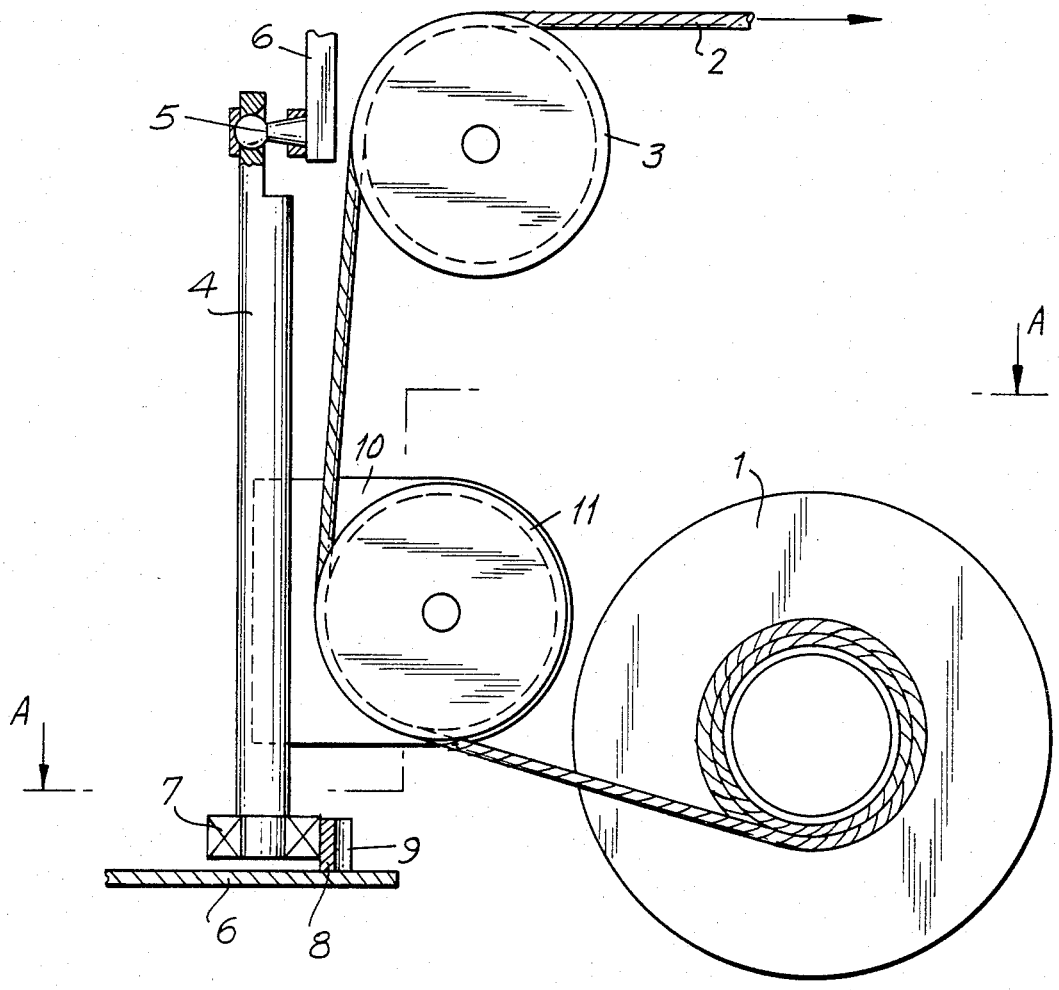
Figure 2:
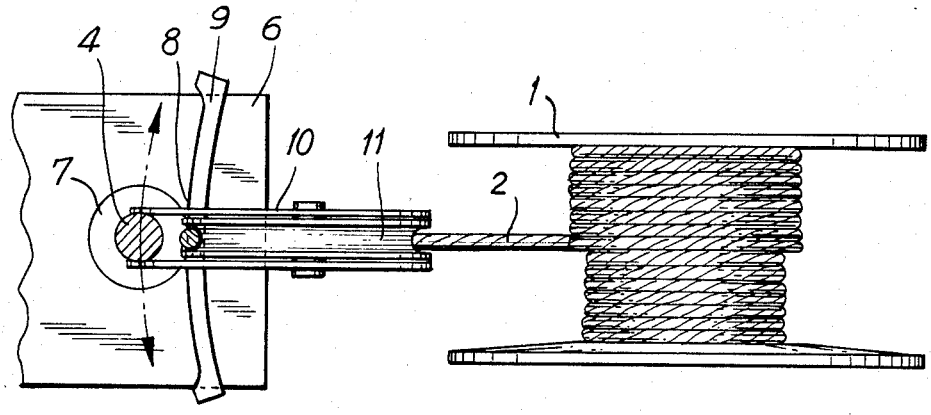

One embodiment of the invention will now be described with reference to the accompanying drawings in which;

FIG. 1 is a vertical side elevation of the device and part of the surrounding frame on which it is fitted and, FIG. 2 is a top elevation taken along line A—A on FIG. 1.

Referring now to the drawings, a winding drum 1 for a tractor which is shown. The drum 1 is rotatably mounted on a winch-frame (not shown), and is connected to a conventional driving mechanism for rotation of the drum (not shown). The rope 2 runs over a fixed frame pulley 3. In the embodiment shown on the drawings the fixed frame pulley 3 has its fixing point laying in a plane standing at a right angle to the axis of rotation of the drum 1 and runs through the center of the drum 1.

The feeding device for guiding the rope onto the drum comprises a pendulum 4 that at its upper end is spherically pivoted to the winch frame 6 by means of a bearing 5. The suspension point for the pendulum 4 is situated in the same plane in relation to the drum 1 as the suspension point for the pulley 3.

At its lower end the pendulum 4 carries a roller 7 which is intended to roll on curved path 8 of a flange 9, said flange 9 being adjustably mounted on the frame 6. The flange 9 has a length that exceeds the width of the drum 1 and is arranged parallel to the axis of rotation of the drum 1 as shown in FIG. 2. A bracket 10 is fixed to the pendulum 4 and a guide pulley 11 for the rope 2 is mounted on the bracket 10.

The rope 2 runs from the fixed frame pulley 3 over the guide pulley 11 and onto the winding drum 1. The curved path 8 on the flange 9 is so shaped that the length of the rope 2 from that point on the fixed frame pulley 3 where the rope leaves the pulley 3 over the guide pulley 11 to the point where the rope enters onto the winding drum 1, at any time and any position of the pendulum is constant.

The device according to the present invention operate as follows:

When the rope 2 is tightened by rotation of the drum 1, the roller 7 on the lower end of the pendulum 4 is forced against the curved path 8 on the flange 9. The rope 2 will then pull on the guide pulley 11 and the pendulum 4 will move and the rope will thereby be coiled in closely and evenly wrapped layers over the whole width of the drum. While coiling the rope 2 on the drum 1, the pendulum 4 with the roller 7 and the guide pulley 11 will move as indicated by the arrows on FIG. 2, because the force necessary for the rope 2 to climb on the previous coil on the drum is greater than the force necessary to move the pendulum 4.

When the fixed frame pulley 3 and the pendulum 4 is arranged as shown on the drawings, the curved path 8 on the flange 9 is symmetrical around its transversal axis. However, the fixed frame pulley 3 and the pendulum 4 can be situated in a plane which forms an angle of 90° with the axis of rotation of the drum 1 and which runs through the drum. In this case the form of the curved path must be shaped so that the requirements mentioned above is fulfilled.

To adjust the position of the flange 9 and thereby the curved path 8, the flange 9 preferably has adjustable brackets.

I claim:

1. A feed device for guiding a rope from a fixed frame pulley onto a winding drum mounted on a frame wherein said device comprises a fixed frame pulley, a pendulum which is spherically pivoted at one end to the frame and at its second end has secured a roller which rolls on a curved path on a flange mounted on the frame said pendulum having mounted thereon at least one guide pulley for the rope whereby the guide pulley may be moved along the axis of rotation of the winding drum and toward and away from said axis to maintain a substantially constant distance of rope between said fixed frame pulley and winding drum.

2. Device according to claim 1, wherein the pendulum is spherically pivoted to the frame above the drum at a point lying in a plane having an angle of 90° with the axis of rotation of the drum and running through the center of the drum.

3. Device according to claim 1 wherein the curved path on said flange is symmetrically positioned relative to the axis of rotation of the drum.

4. Device according to claim 2 wherein the curved path on said flange is symmetrically positioned relative to the axis of rotation of the drum.

* * * * *